US006731212B2

(12) United States Patent
Hirose et al.

(10) Patent No.: US 6,731,212 B2
(45) Date of Patent: May 4, 2004

(54) TAG DEVICE

(75) Inventors: Yuuki Hirose, Mino (JP); Soichiro Makiyama, Kobe (JP)

(73) Assignees: Sanyo Electric Co., Ltd., Moriguchi (JP); Sanyo Tuner Industries Co., Ltd., Osaka (JP)

( * ) Notice: Subject to any disclaimer, the term of this patent is extended or adjusted under 35 U.S.C. 154(b) by 31 days.

(21) Appl. No.: 10/144,770

(22) Filed: May 15, 2002

(65) Prior Publication Data

US 2002/0171550 A1 Nov. 21, 2002

(30) Foreign Application Priority Data

May 16, 2001 (JP) ..... 2001-146749

(51) Int. Cl.[7] ..... G08B 13/14; E05B 73/00; E05B 65/00; E05B 65/52

(52) U.S. Cl. ..... 340/572.9; 340/572.1; 70/18; 70/57.1; 70/63; 70/53

(58) Field of Search ..... 340/572.9, 572.1; 70/63, 57.1, 30, 49, 18, 53, 278.7

(56) References Cited

U.S. PATENT DOCUMENTS 4,920,334 A * 4/1990 DeVolpi ..... 340/568.4
5,161,396 A * 11/1992 Loeff ..... 70/63
5,191,314 A * 3/1993 Ackerman et al. ..... 340/542
5,610,587 A * 3/1997 Fujiuchi et al. ..... 340/568.2
5,656,998 A * 8/1997 Fujiuchi et al. ..... 340/571
5,959,532 A * 9/1999 Fujiuchi et al. ..... 340/572.3
6,243,005 B1 * 6/2001 Haimovich et al. ..... 340/427

* cited by examiner

*Primary Examiner*—Jeffery Hofsass
*Assistant Examiner*—Lam Pham
(74) *Attorney, Agent, or Firm*—Armstrong, Kratz, Quintos, Hanson & Brooks, LLP

(57) ABSTRACT

In a tag device wherein a wire 2 has a base end 21 fixed to a tag body 10 and a forward end 23 connected to the tag body 10 as releasably locked thereto, the wire 2 is provided at its forward end 23 with a lock pin 22. The tag body 10 comprises a case 1 having a pin insertion hole 13, and a latch member 3 engageable with the lock pin 22. The latch member 3 comprises a main body 31 supported inside the case 1 and a spring piece 32 provided on the main body 31. The latch member 3 prevents the thick rod portion 26 from slipping off when moved in one direction to a limit position, and allows the thick rod portion 26 to slip off when moved in the other direction to a limit position.

11 Claims, 11 Drawing Sheets

TAG DEVICE

FIELD OF THE INVENTION

The present invention relates to tag devices to be attached to articles such as bags for preventing the article from being stolen or unlawfully brought out of a predetermined monitoring area.

BACKGROUND OF THE INVENTION

Tag devices of the type mentioned already known comprise a tag body and a wire having a base end fixed to the tag body and a forward end provided with a lock pin which is connected to the tag body as releasably locked thereto. The tag device is attached to an article by unlocking the lock pin from the tag body, winding the wire around the article and thereafter locking the lock pin to the tag body.

When an attempt is made to bring out the article having the tag device thus attached thereto from a predetermined monitoring area (for example, from a store), the tag device receives radio waves (alarm actuating signal) emitted from an entrance-exit gate, whereupon a buzzer in the tag body goes on, giving notice of the occurrence of theft. Alternatively if it is attempted to cut the wire of the tag device attached to the article and bring out the article only from the monitoring area, the break in the wire is detected by the tag body, whereupon the buzzer in the tag body goes on, giving notice of the occurrence of theft.

With the conventional tag device, the lock pin attached to the forward end of the wire is locked to the tag body by pushing the lock pin into a metal latch member to thereby engage the latch member with the lock pin, and is released from the tag body by elastically deforming the latch member with use of an unlocking member and thereby disengaging the latch member from the lock pin. In order to lock the lock pin to the tag body by the latch member reliably, therefore, the portion of the latch member to be engaged with the lock pin needs to be as high as possible in rigidity (difficulty of elastic deformation) so as not to elastically deform easily under the action of an impact or the like.

Nevertheless, giving high rigidity to the portion of the latch member to be engaged with the lock pin requires a great force for unlocking the lock pin with use of the unlocking member, entailing the problem of making the unlocking member difficult to use. Even if the unlocking member is driven by a solenoid or the like, there arises the problem of necessitating a great electric power. Additionally, the higher the rigidity of the engagement portion of the latch member for the lock pin, the greater is the elastic repulsive force involved in the engagement. Since the elastic repulsive force acts toward the direction unlocking, there is a likelihood that the lock pin will be unlocked when subjected to a small impact.

SUMMARY OF THE INVENTION

Accordingly, an object of the present invention is to provide a tag device which is adapted to realize a reliable locked state and yet which ensures facilitated unlocking.

The present invention provides a tag device comprising a tag body 10 and a wire 2 fixed at a base end 21 thereof to the tag body 10 and having a lock pin 22 attached to a forward end 23 thereof. The lock pin 22 has a thick rod portion 26 at an outer end of a thin rod portion 25. The tag body 10 comprises a case 1 having a pin insertion hole 13 permitting the lock pin 22 to pass therethrough, and a latch member 3 disposed inside the case 1 and engageable with the lock pin 22 as inserted through the hole 13.

The latch member 3 comprises a main body 31 supported inside the case 1 and reciprocatingly movable in directions orthogonal to the direction of insertion of the lock pin 22, and a spring piece 32 provided on the main body 31 and elastically shiftable in a direction intersecting the direction of insertion of the lock pin 22. The latch member 3 permits the spring piece 32 to be opposed to the thin rod portion 25 of the lock pin 22 in an inserted position to prevent the thick rod portion 26 from moving in a slipping-off direction when moved in one direction to a limit position, and permits the spring piece 32 to be positioned away from the thin rod portion 25 of the lock pin 22 in the inserted position to allow the thick rod portion 26 to move in the slipping-off direction when moved in the other direction to a limit position.

According to the tag device of the invention, with the latch member 3 moved in the above-mentioned one direction to the limit position, the lock pin 22 is pushed into the latch member 3 through the pin insertion hole 13 in the tag body 10, whereby the thick rod portion 26 of the lock pin 22 is moved past the spring piece 32 of the latch member 3, positioning the thin rod portion 25 as opposed to the spring piece 32. In this process, the spring piece 32 of the latch member 3 is elastically deformed by sliding contact with the outer peripheral surface of the thick rod portion 26 and is thereafter opposed to the outer peripheral surface of the thin rod portion 25 to elastically restore itself. As positioned in proximity to the outer peripheral surface of the thin rod portion 25, the spring piece 32 prevents the thick rod portion 26 from moving in the slipping-off direction (locked state). Accordingly, even if an external force acts in a direction to withdraw the lock pin 22 from the tag body 10, the thick rod portion 26 bears on the spring piece 32 of the latch member 3, whereby the lock pin 22 is prevented from slipping out of the tag body.

When the lock pin 22 is to be lawfully handled for removal from the tag body 10, the latch member 3 is moved in the other direction to the corresponding limit position, and the lock pin 22 is thereafter pulled out from the tag body 10. The movement of the latch member 3 moves the spring piece 32 away from the thin rod portion 25 of the lock pin 22, permitting the thick rod portion 26 to move in the slipping-off direction, so that the lock pin thick rod portion 26 moves without being restrained by the spring piece 32, slipping out of the pin insertion hole 13 of the tag body 10.

The movement of the latch member 3 between the locking position and the unlocking position merely involves slight frictional resistance offered to the latch member 3 by the neighboring members. The latch member 3 can therefore be driven reciprocatingly without requiring any great force.

Stated more specifically, the thick rod portion 26 of the lock pin 22 is provided at an outer end thereof with a tapered face 27 for elastically shifting the spring piece 32 of the latch member 3 by pushing with the insertion of the lock pin 22. Accordingly, while the lock pin 22 is being pushed into the latch member 3, the tapered face 27 of the lock pin 22 comes into pressing contact with the spring piece 32 of the latch member 3 and elastically shifts the spring piece. Thus, the thick rod portion 26 of the lock pin 22 is brought into sliding contact with the latch member spring piece 32.

Further stated more specifically, the tag body 10 has incorporated therein a solenoid 5 for reciprocatingly driving the latch member 3 by an attracting/releasing movement of a rod 51, and a control circuit for controlling the operation of the solenoid 5. The latch member 3 can then be reciprocatingly moved between a locking position and an unlocking position by the rod 51 attracting/releasing movement of the solenoid 5.

The solenoid 5 as unenergized retains a locking operative state, for example by virtue of the magnetic force of a permanent magnet incorporated therein, to hold the latch member 3 moved to a lock pin 22 locking position. Accordingly, no electric power is required for holding the latch member 3 in the locking position, hence a reduction in power consumption.

The solenoid 5 is provided with a spring 53 for biasing the rod 51 from the locking operative state toward an unlocking operative state. Accordingly, the force required for moving the latch member 3 from the locking position to the unlocking position is partly provided by the elastic restoring force of the spring 53.

Further stated more specifically, the tag body 10 has a switch 6 for detecting the movement of the latch member 3 from the lock pin locking position to the unlocking position where the lock pin 22 is unlocked, and the control circuit commands the solenoid 5 to perform a locking operation upon detecting the unlocking operative state based on a detection signal from the switch 6. Accordingly, even when the latch member 3 or the solenoid 5 in the locking position or state is subjected, for example, to a great impact to bring the rod 51 of the solenoid 5 into the unlocking operative state and release the lock pin, this situation is detected by the switch 6, whereupon the solenoid 5 is given a command to perform a locking operation. The latch member 3 is therefore driven to the locking position immediately after unlocking to resume the locking state.

Further stated more specifically, the control circuit holds the solenoid 5 in an unlocking operative state only for a specified period of time in response to an unlocking signal. Accordingly, when the lock pin 22 is to be removed from the tag body 10 by a lawful procedure, an unlocking signal is sent to the tag body 10, and the lock pin 22 is thereafter pulled out of the tag body 10 before the lapse of the specified period of time.

Further stated more specifically, the tag body 10 has a buzzer 8 incorporated therein, and the control circuit gives an alarm command to the buzzer 8 upon receiving an alarm actuating signal or upon detecting a break in the wire 2, with the lock pin 22 locked by the latch member 3. The buzzer 8 actuated then gives notice of a wrongful act.

Further stated more specifically, the control circuit gives an alarm stop command to the buzzer 8 upon receiving an alarm cancel signal during alarming or when alarming continues for a predetermined period of time. The buzzer 8 is then brought out of operation by sending the alarm cancel signal to the tag body 10 during alarming or by allowing the alarming operation to continue only for the predetermined period of time.

Further stated more specifically, upon the control circuit receiving an alarm actuating signal or detecting a break in the wire 2, with the lock pin 22 locked by the latch member 3, the control circuit wirelessly emits an alarm information signal giving notice of the situation. An unlawful act can then be found by monitoring the reception of an alarm information signal, for example, in a monitoring room.

The tag device embodying the invention as described above is adapted to realize a reliable locking state by using a locking mechanism wherein the spring piece 32 of the latch member 3 is deeply engaged with the lock pin 22, also realizing a facilitated unlocking procedure by using an unlocking mechanism wherein the latch member 3 is moved away from the lock pin 22.

DETAILED DESCRIPTION OF EMBODIMENT

Figure 1:
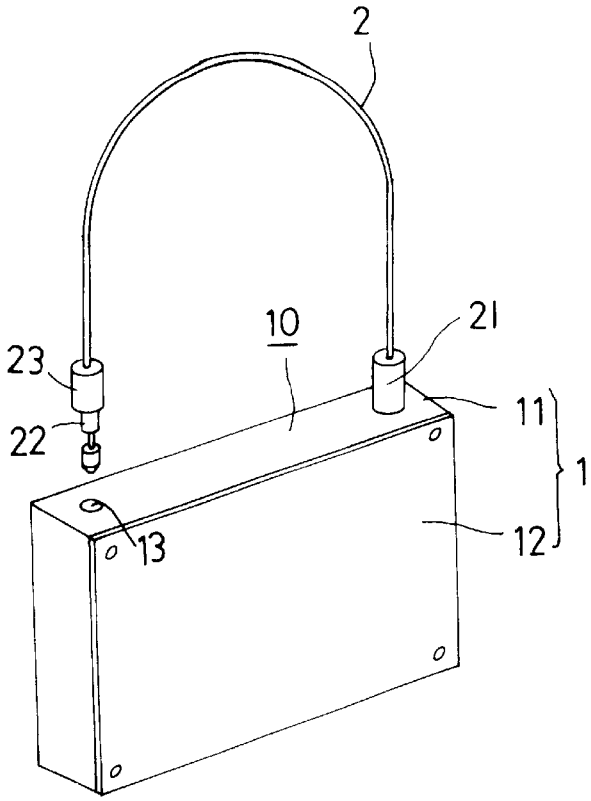
FIG. 1 is a perspective view of a tag device of the invention.

An embodiment of the present invention will be described in detail with reference to the drawings. The tag device embodying the invention comprises a tag body 10 and a wire 2 fixed at a base end 21 thereof to the tag body 10 and having a lock pin 22 attached to a forward end 23 thereof as shown in FIG. 1. The tag body 10 is in the form of a rectangular parallelepipedal case 1 comprising a case body 11 having an open side and a closure 12 covering the opening. The case body 11 has an upper wall provided with a pin insertion hole 13 for inserting the lock pin 22 therethrough.

Figure 2:
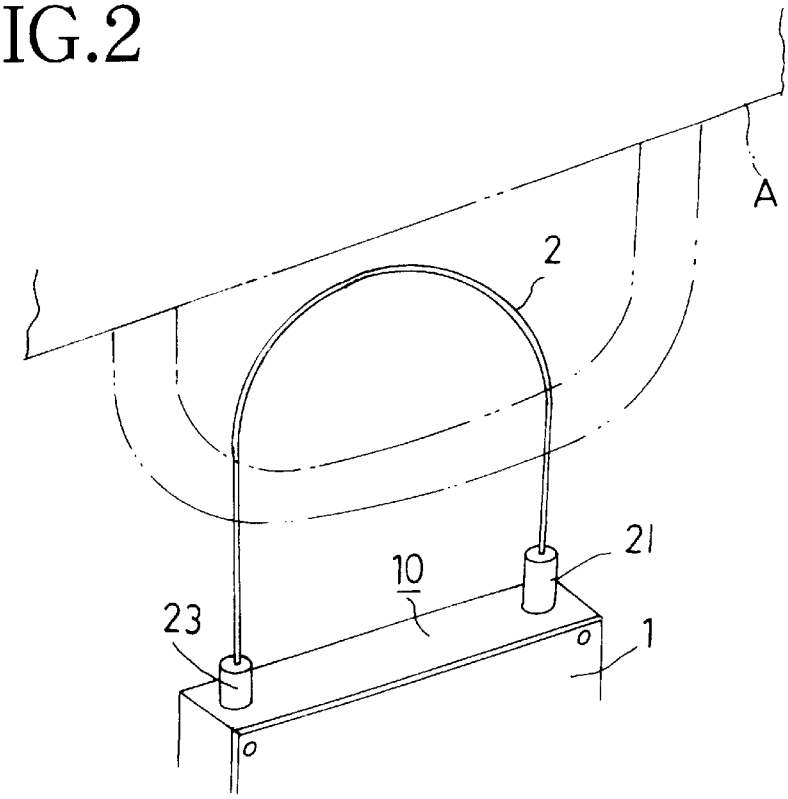
FIG. 2 is a perspective view showing the tag device as attached to an article.

With reference to FIG. 2, the wire 2 is wound around an article A, and the lock pin 22 is pushed into the tag body 10 through the hole 13, whereby the tag device is attached to the article A with the lock pin 22 locked to the tag body 10. If it is attempted to unlawfully bring out the article A having the tag device attached thereto from a predetermined monitoring area (for example, from a store), radio waves (alarm actuating signal) emitted from an entrance-exit gate are received by the tag body 10, whereupon a buzzer (not shown) incorporated in the tag body 10 goes on, giving notice of the occurrence of theft. Alternatively if the wire 2 attaching the tag device to the article A is cut in an attempt to unlawfully bring out the article A only from the monitoring area, the tag body 10 detects the break in the wire 2, whereupon the buzzer in the tag body 10 goes on to giving notice to the occurrence of theft.

The monitoring clerk manipulates a tag control unit when bringing the tag device out of the alarming operation, or when unlocking the lock pin 22. As will be described later, the tag device receives an alarm cancel signal or unlocking signal wirelessly transmitted from the tag control unit to stop the alarming operation or unlock the lock pin 22.

Figure 3:
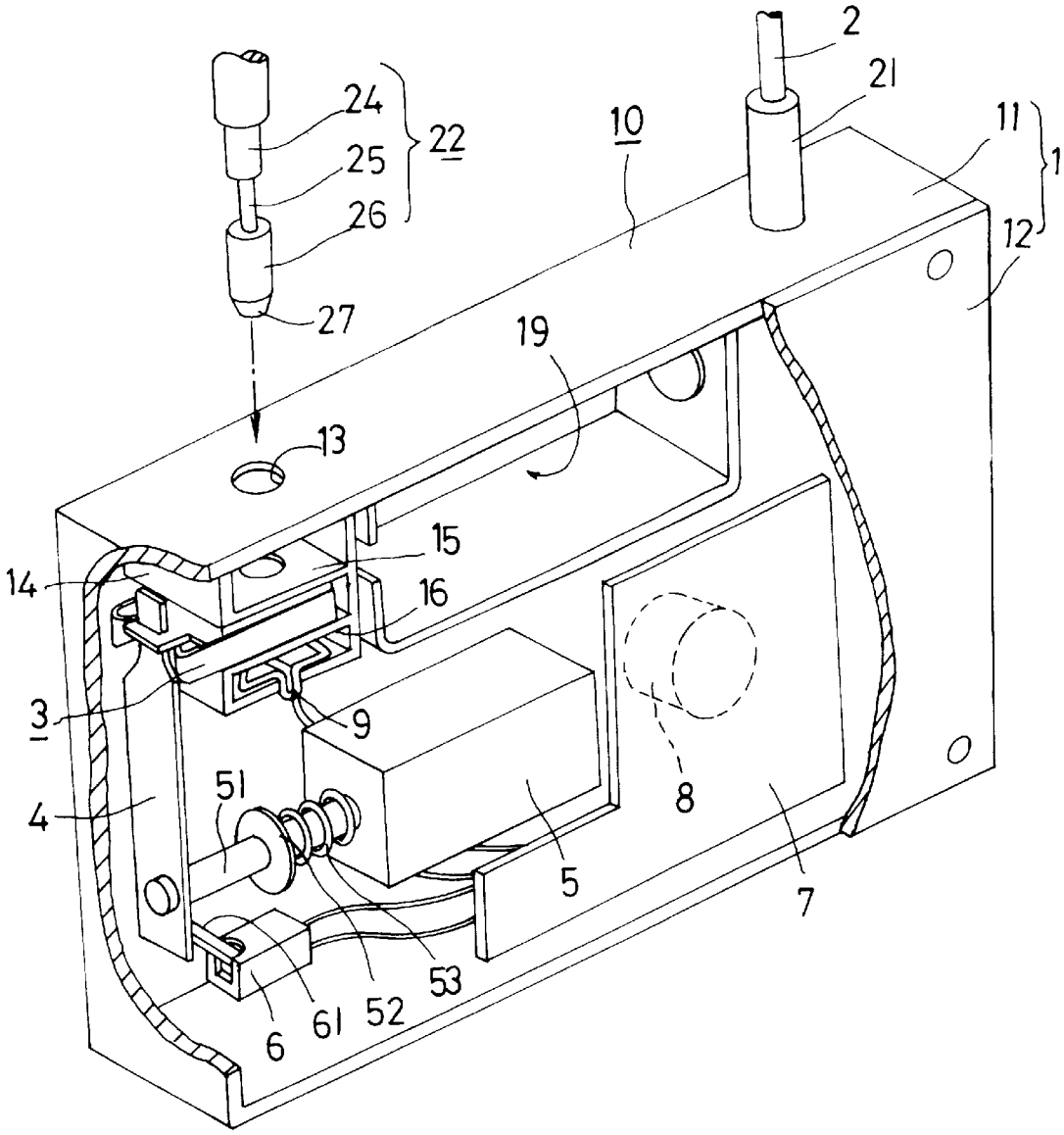
FIG. 3 is a perspective view partly broken away and showing the tag device.
Figure 5:
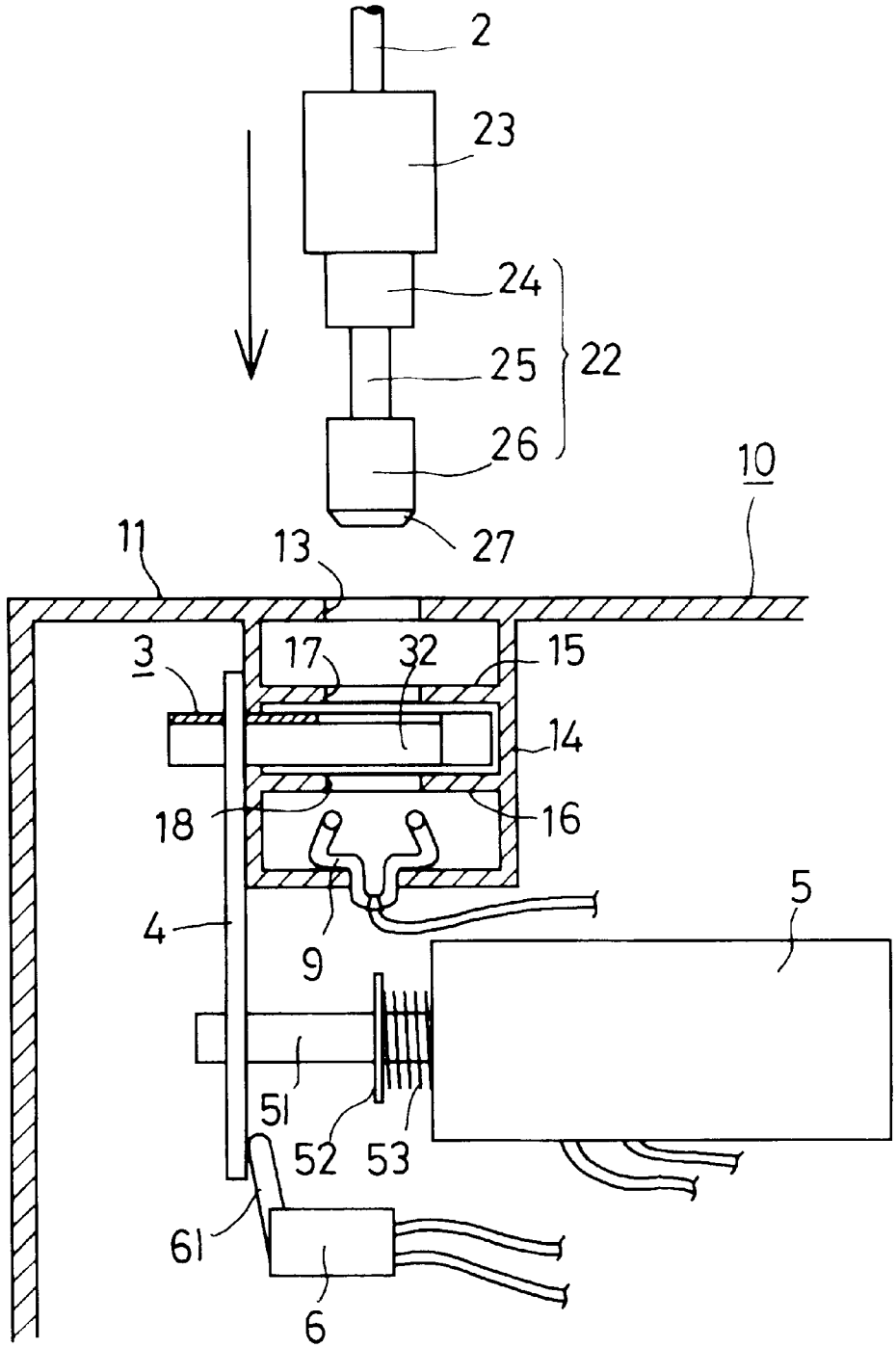
FIG. 5 is a front view partly broken away and showing the main construction with the lock pin positioned away from a tag body.

With the tag device of the present invention, the lock pin 22 is an integral piece shaped from a metal and comprises a first thick rod portion 24, thin rod portion 25 and second rod portion 26 each in the form of a solid cylinder and aligned on the same axis as shown in FIG. 3. The second thick rod portion 26 has an outer end provided with a tapered face 27. Provided inside the case 1 of the tag body 10 is a resin frame 14 which is positioned below the pin insertion hole 13 and molded integrally with the case 1. The frame 14 has a first guide wall 15 and a second guide wall 16 which are horizontal. Disposed between the two guide walls 15, 16 with suitable play is a latch member 3 which is made from a metal plate by press work and which is so supported as to be reciprocatingly slidable in horizontal directions. As shown in FIG. 5, the first and second guide walls 15, 16 have a first through hole 17 and a second through hole 18, respectively, which are circular and permit the passage of the second thick rod portion 26 of the lock pin 22 therethrough.

Figure 4:
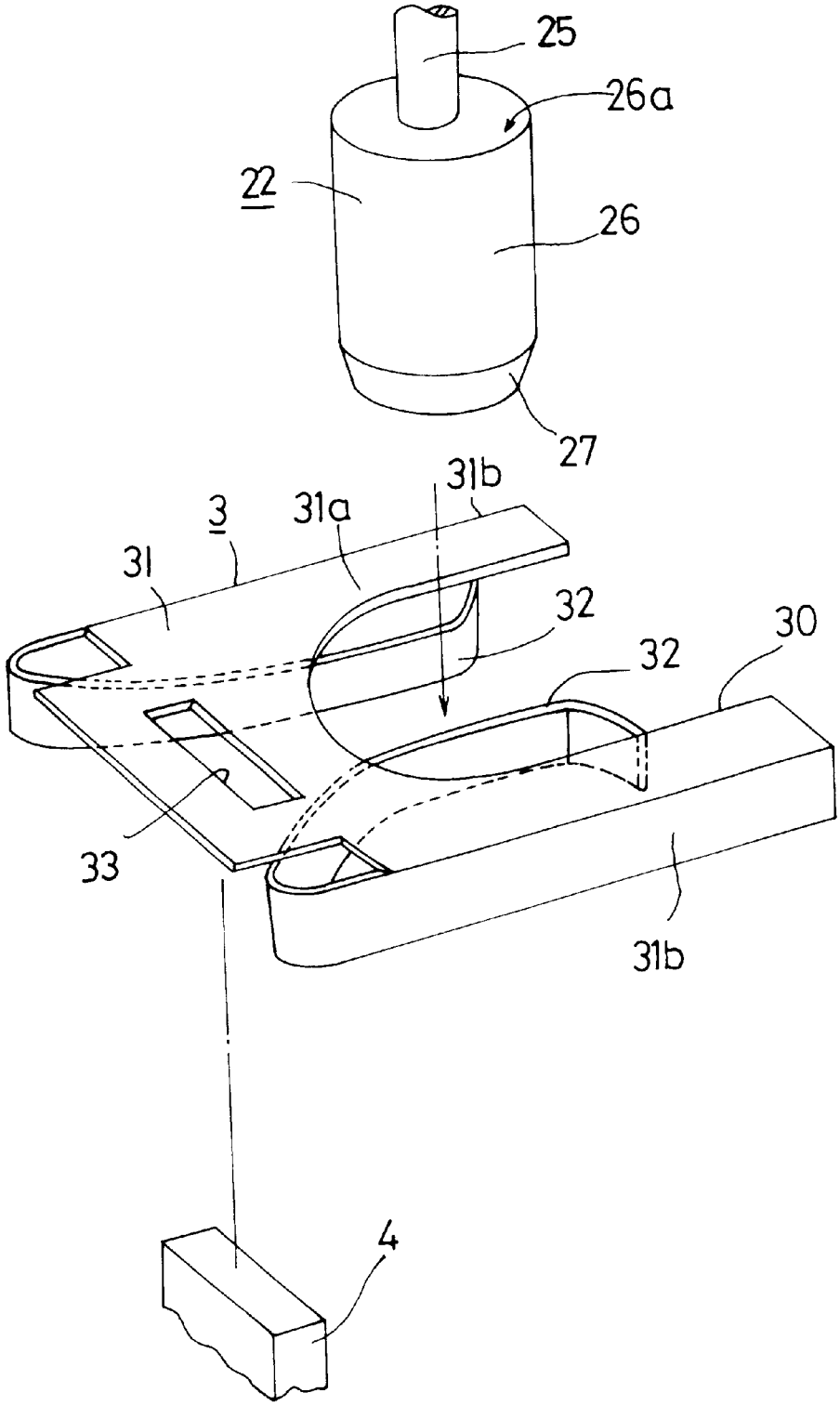
FIG. 4 is an enlarged perspective view of a latch member and a lock pin.

With reference to FIG. 4, the latch member 3 comprises a main body 31 including a horizontal wall 31*a* and vertical walls 31*b*, 31*b* projecting downward from the respective wide edges of the wall 31*a*, and a pair of spring pieces 32, 32 extending horizontally from the respective vertical walls 31*b*, 31*b* of the main body 31, each of the spring pieces 32 extending from one end of the wall 31*b* toward the other end thereof as bent inward. The main body 31 has formed therein a slit 33 for the upper end of a lever 4 to be described later to fit in, and a U-shaped cutout 30 permitting the passage of the lock pin 22 therethrough. The pair of spring pieces 32, 32 are spaced apart by a distance smaller than the diameter of the second thick rod portion 26 of the lock pin 22, and have extended ends which are positioned inwardly of the U-shaped cutout 30 of the main body 31.

Therefore, in the process for pushing the lock pin 22 into the latch member 3, the second thick rod portion 26 of the lock pin 22 first enters the U-shaped cutout 30 of the latch member 3, with the tapered face 27 of the rod portion 26 brought into sliding contact with the two spring pieces 32, 32. As the lock pin 22 is further pushed in, the tapered face 27 pushes the spring pieces 32, 32 open, bringing the second thick rod portion 26 into sliding contact with the spring pieces 32, 32. When the lock pin 22 is further pushed in, the second thick rod portion 26 moves past the spring pieces 32, 32, positioning the thin rod portion 25 as opposed to the spring pieces 32, 32. This elastically restores the spring pieces 32, 32 toward each other, causing the spring pieces 32, 32 to clamp the thin rod portion 25 therebetween. As a result, an end face 26*a* of the second thick rod portion 26 bears on the two spring pieces 32, 32, which prevent the rod portion 26 from moving in a slipping-off direction.

As shown in FIG. 3, the lever 4 extending vertically along a side wall of the case body 11 has an upper end joined to the latch member 3 and a lower end having joined thereto the outer end of a rod 51 of a solenoid 5 fixed to the case body 11. Accordingly, a rod attracting/releasing movement of the solenoid 5 reciprocatingly moves the latch member 3 in horizontal directions.

The solenoid 5 is of the self-holding type, such that the magnetic force of a permanent magnet (not shown) incorporated therein holds the rod 51 in an attracted position. The rod 51 is provided at an intermediate portion thereof with a flange 52 and carries a coil spring 53 interposed between the flange 52 and the solenoid body. By changing the polarity of energization, the solenoid 5 can be changed over between the attracting operation of moving the rod 51 from a released position to the attracted position against the coil spring 53 and the release operation of moving the rod 51 from the attracted position to the released position against the magnetic force.

A circuit board 7 disposed in the interior of the case 1 has mounted thereon a buzzer 8 and an electronic circuit for controlling, for example, the attracting/releasing movement of the solenoid 5 and the alarming operation of the buzzer 8. The case 1 has further formed therein a cell chamber 19 to be loaded with a dry cell serving as a power source for the solenoid 5 and the electronic circuit. A switch 6 having an actuator 61 projecting toward the base end of the lever 4 is provided in the case 1. The switch 6 detects two operating states of the solenoid 5, i.e., a locking operative state wherein the solenoid 5 attracts the rod 51 to lock the lock pin 22 by the latch member 5, and an unlocking operative state wherein the solenoid 5 releases the rod 51 for the latch member 5 to release the lock pin 22.

Further provided inside the case 1 is a metal connector pin 9 having a bifurcated upper end and mounted on the bottom of the frame 14. The connector pin 9 has a base end connected to an input port of a microcomputer by a pull-up signal line on the circuit board 7 as will be described later. When the lock pin 22 is pushed into the latch member 3, the second thick rod portion 26 of the lock pin 22 is clamped by the bifurcated upper end of the connector pin 9, whereby the lock pin 22 is electrically grounded via the connector pin 9.

Figure 9:
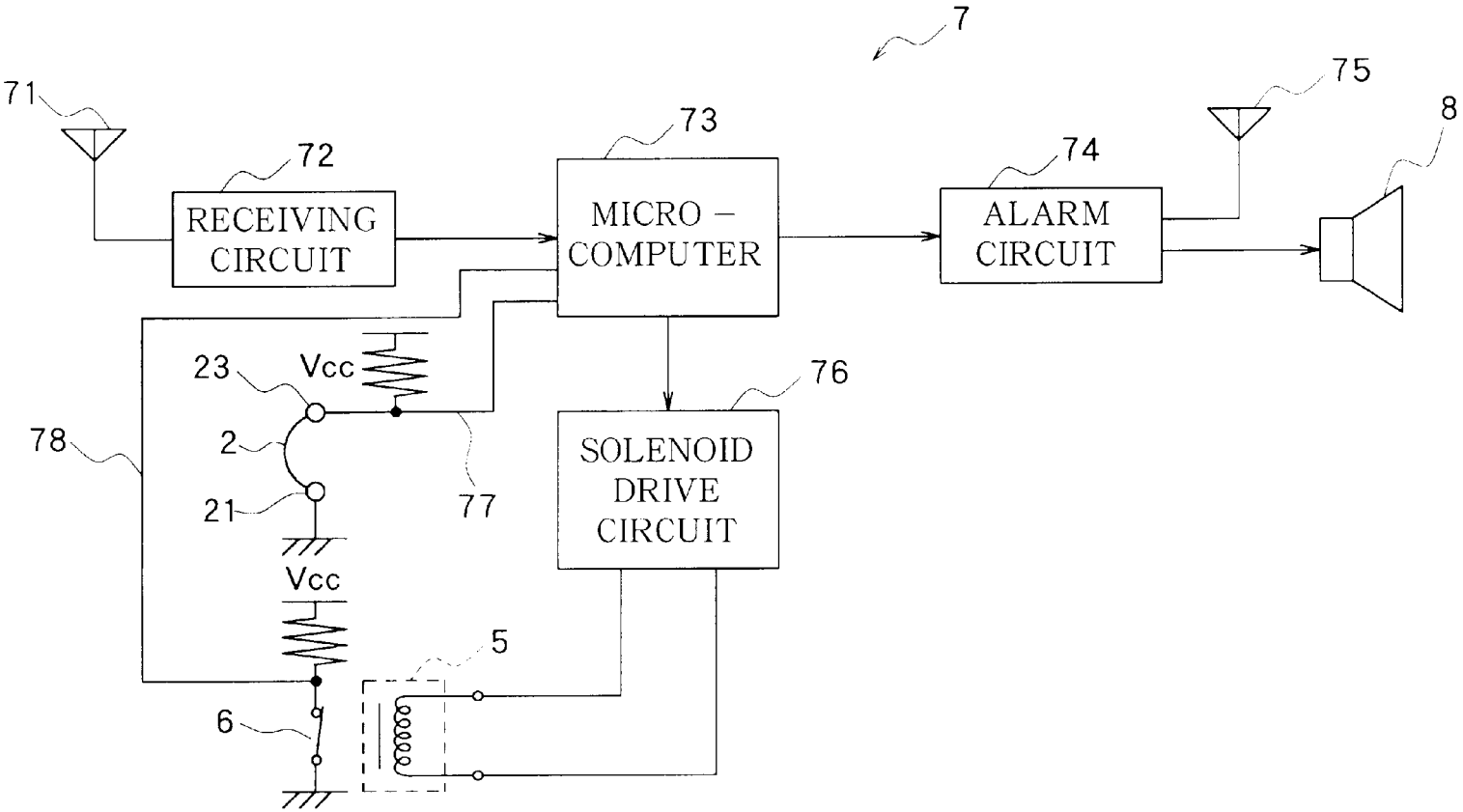
FIG. 9 is a block diagram showing the circuit construction of the tag device.

FIG. 9 shows the construction of the electronic circuit provided on the circuit board 7 in the tag body 10. The circuit comprises a receiving circuit 72 provided with a receiving antenna 71 for receiving an alarm actuating signal, alarm cancel signal and unlocking signal wirelessly transmitted from outside, the above-mentioned microcomputer 73 for executing various control operations in response to the received signals, an alarm circuit 74 for driving the buzzer 8 in response to a control signal from the microcomputer 73 and transmitting an alarm information signal via a transmitting antenna 75, and a solenoid drive circuit 76 for driving the solenoid 5 in accordance with a control signal from the microcomputer 73.

The base end 21 of the wire 2 is electrically connected. When the lock pin 22 is pushed into the latch member 3, the second thick rod portion 26 of the pin 22 is clamped by the bifurcated upper end of the connector pin 9, whereby the forward end 23 of the wire 2 is connected to the input port of the microcomputer 73 via the signal line 77 having a pull-up resistor connected thereto, and the input port of the microcomputer 73 is grounded via the wire 2. Accordingly, when the lock pin 22 is locked as pushed into the tag body 10, the signal to be input to the microcomputer 73 changes from high to low, whereby the locked state of the lock pin 22, i.e., the closed state of the wire 2, is detected. If the wire 2 is cut by an unlawful act, the signal to be input to the microcomputer 73 changes from low to high, whereby the unlawful act is detected.

One end of the switch 6 is connected to the microcomputer 73 by the signal line 78 having the pull-up resistor connected thereto. The other end of the switch 6 is grounded. Accordingly, when the rod 51 of the solenoid 5 moves from the locking position to the unlocking position to turn off the switch 6, the signal to be input to the microcomputer 73 changes from low to high, whereby the movement of the solenoid 5 to the unlocking position is detected.

Figure 10:
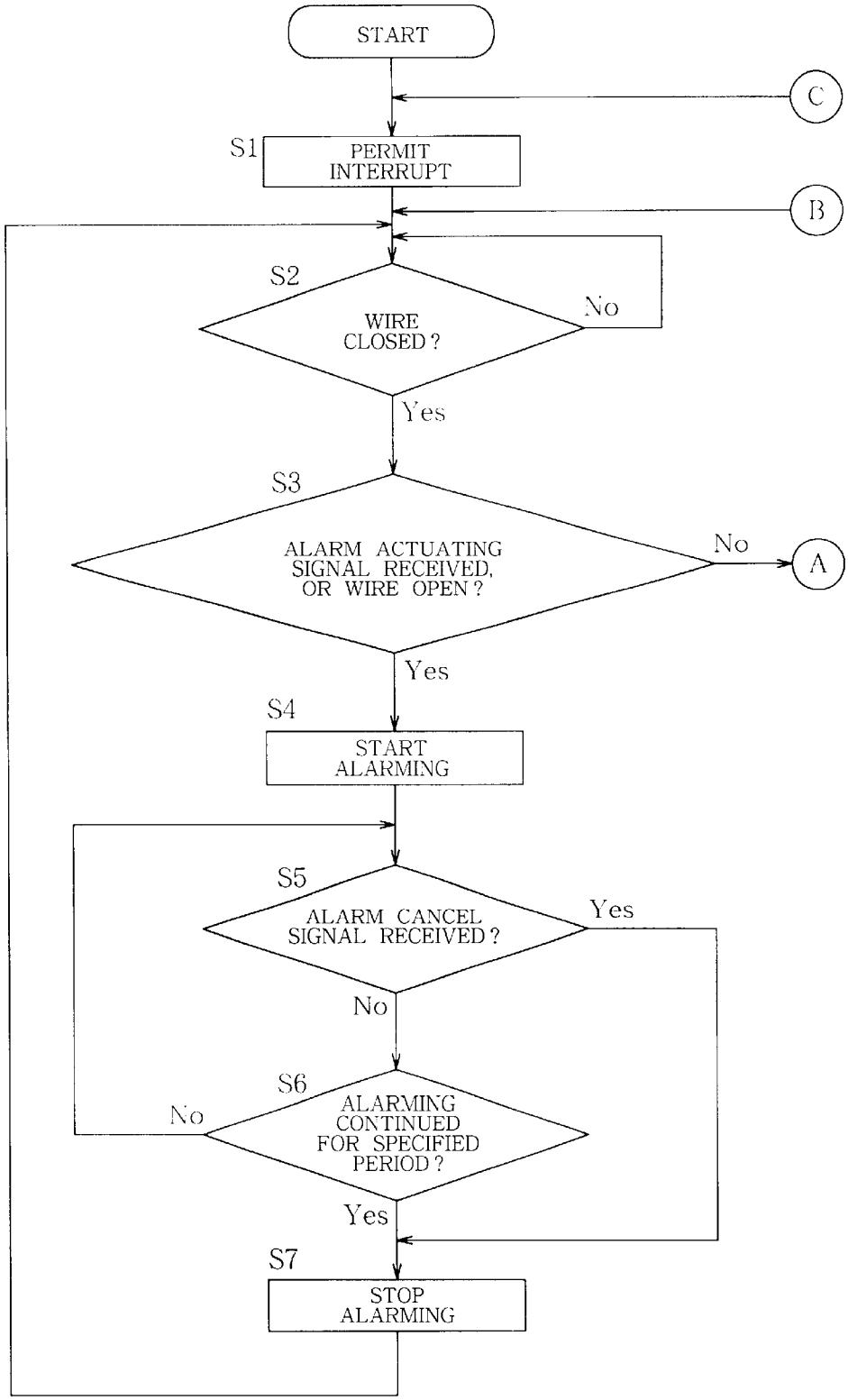
FIG. 10 is a flow chart showing the first half of a procedure for controlling the tag device.
Figure 11:
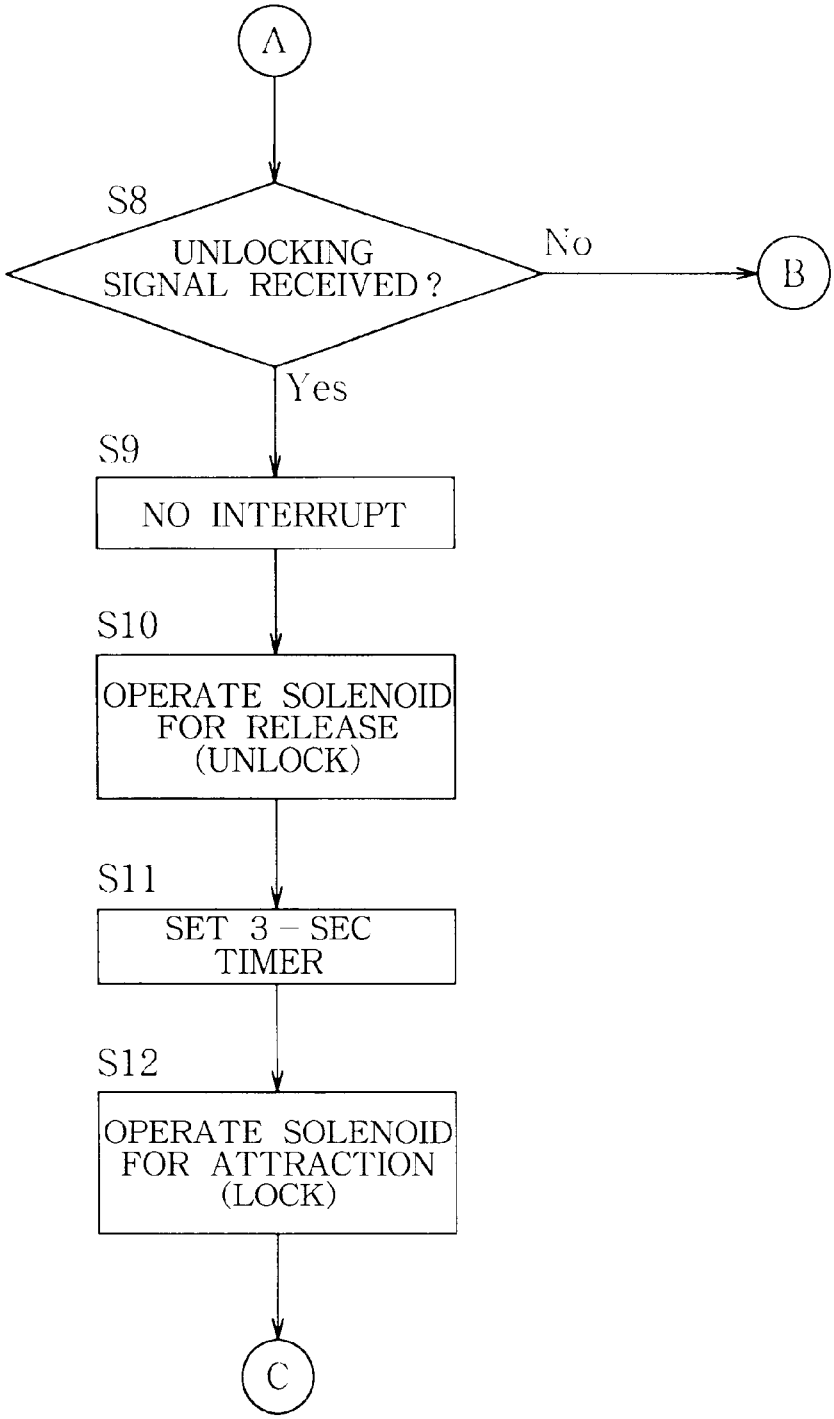
FIG. 11 is a flow chart showing the second half of the procedure for controlling the tag device.
Figure 12:
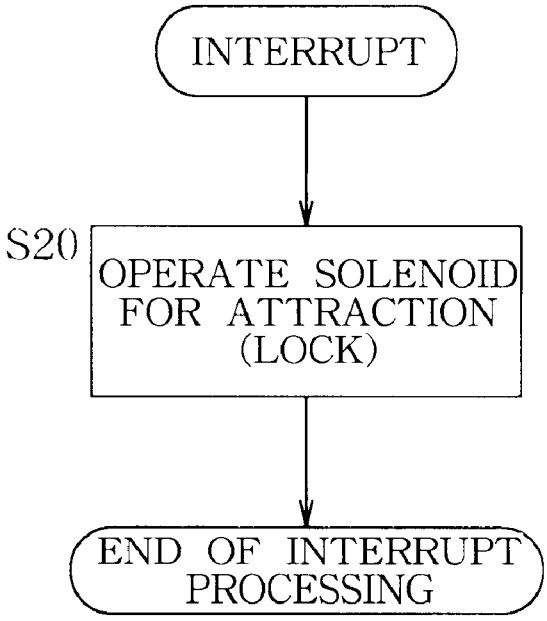
FIG. 12 is a flow chart showing interrupt processing to be executed during the control procedure.

FIGS. 10 and 11 show the control operation of the microcomputer 73. FIG. 12 shows the interrupt processing to be executed periodically during the control operation. Step S20 is performed on condition that the switch 6 is off, commanding the solenoid to perform an attracting movement (locking).

First, FIG. 10, step S1 permits an interrupt, and an inquiry is made in step S2 as to whether the wire is in the closed state. If the answer is affirmative, step S3 follows to inquire whether an alarm actuating signal has been received or whether the wire is open. If an attempt is made to bring out the tag device along with an article from the monitoring area, the alarm actuating signal emitted by the entrance-exit gate is received, and the inquiry is answered in the affirmative. An affirmative answer is also given in the event of a break occurring in the wire.

When the inquiry of step S3 is answered in the affirmative, step S4 follows to start an alarming operation, i.e., actuation of the buzzer 8 and transmission of an alarm information signal. Step S5 thereafter inquires whether an alarm cancel signal has been received. If the answer is negative, step S6 follows to inquire whether the alarming operation has been continued for a predetermined period of time (e.g., for 5 minutes). When the answer is negative, step S5 follows again. This continues the alarming operation. When the answer to the inquiry of step S5 is thereafter found to be affirmative, or if the inquiry of step S6 is answered in the affirmative, the alarming operation is discontinued in step S7, and the sequence returns to step S2.

If the inquiry of step S3 is answered in the negative, on the other hand, FIG. 11, step S8 follows to inquire whether an unlocking signal has been received. When the answer is negative, FIG. 10, step S2 follows again. Conversely, if the answer is affirmative, the sequence proceeds to FIG. 11, step S9 to permit no interrupt. Subsequently step S10 commands the solenoid to operate for releasing (unlocking movement), and a 3-sec timer is thereafter set in step S11. Subsequently, the solenoid is commanded to operate for attraction (locking movement) in step S12, followed by FIG. 10, step S1 again.

FIGS. 5 to 8 show a sequence of operations of the tag device. FIG. 5 shows the lock pin 22 as removed from the tag body 10, and the solenoid 5 as operated for attraction holds the latch member 5 in the locking position at the limit position of rightward movement. In this state, the solenoid 5 is unenergized, holding the rod 51 in the attracted position by the magnetic force. The switch 6 has its actuator pressed by the lever 4 and is held on.

Figure 6:
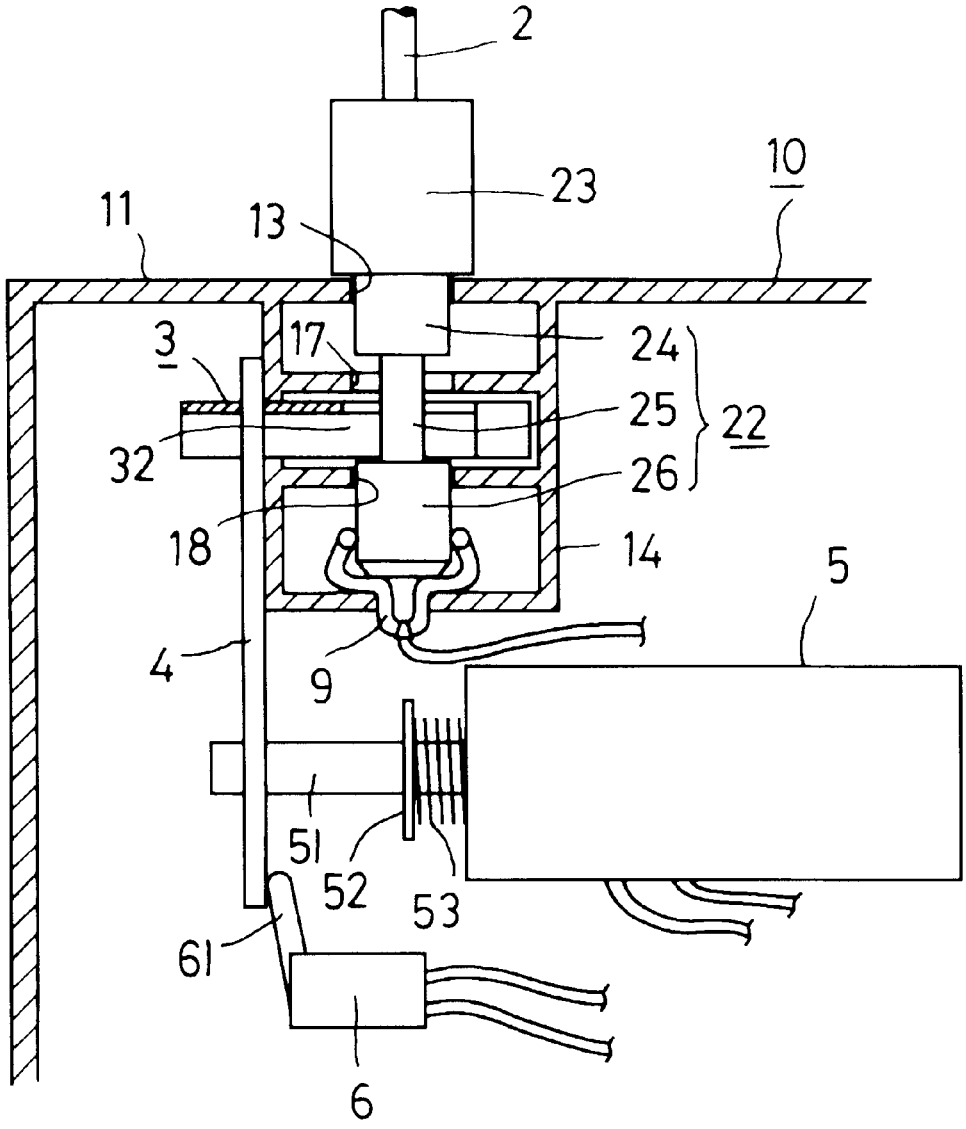
FIG. 6 is a front view partly broken away and showing the main construction with the lock pin locked in the tag body.

The lock pin 22 is lowered toward the pin insertion hole 13 of the tag body 10 as indicated by an arrow and pushed into the frame 14, whereby the second thick rod portion 26 of the lock pin 22 is moved past the first through hole 17 of the frame 14 and passed through the second through hole 18 to reach a position below the spring pieces 32 of the latch member 3. The rod portion 26 is in engagement with the connector pin 9 as shown in FIG. 6. In this state, the pair of spring pieces 32, 32 of the latch member 3 are elastically restored as opposed to the thin rod portion 25 of the lock pin 22, preventing the second thick rod portion 26 of the lock pin 22 from slipping off. Accordingly, even if it is attempted to pull out the lock pin 22 to remove the article from the tag body 10, the second thick rod portion 26 of the pin 22 bears on the spring pieces 32, 32 of the latch member 3, preventing the pin from slipping out.

When the monitoring clerk is to unlock the lock pin 22 in this state, he manipulates the tag control unit to transmit an unlocking signal to the tag body 10. The unlocking signal is received by the receiving circuit 72 shown in FIG. 9, with the result that the solenoid operates for releasing. Thus, the solenoid 5 advances the rod 51 as indicated by an arrow in FIG. 7, moving the latch member 3 (leftward) away from the frame 14. Consequently, the spring pieces 32, 32 of the latch member 3 are removed from the lock pin 22, reaching the unlocking position at the limit position of leftward movement and unlocking the lock pin 22. The lever 4 also moves away from the actuator 61 of the switch 6 to turn off the switch 6. Incidentally, the power needed for moving the latch member 3 corresponds only to the frictional resistance produced between the latch member 3 and the frame 14 and is therefore very small in magnitude.

Figure 8:
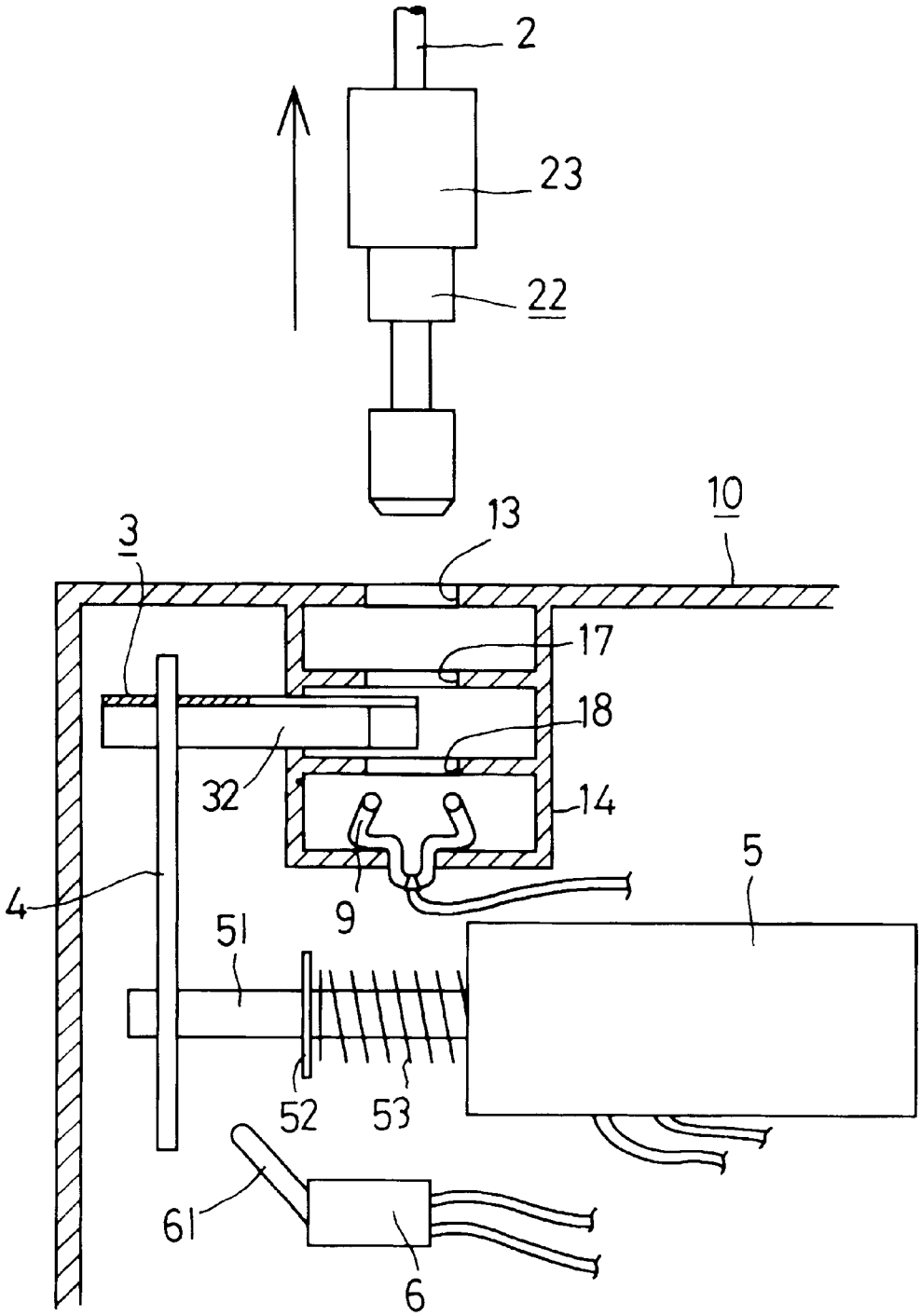
FIG. 8 is a front view partly broken away and showing the main construction with the lock pin removed from a tag body.

After transmitting the unlocking signal to the tag body 10, the monitoring clerk pulls out the lock pin 22 from the tag body 10 as indicated by an arrow in FIG. 8 before the lapse of three seconds. With the spring pieces 32, 32 of the latch member 3 positioned away from the lock pin 22 at this time, the lock pin 22 can be easily pulled out since there is nothing impeding the movement of the pin 22. Upon the lapse of three seconds after the releasing operation of the solenoid 5, the solenoid 5 operates for attraction, resuming the position shown in FIG. 5.

Figure 7:
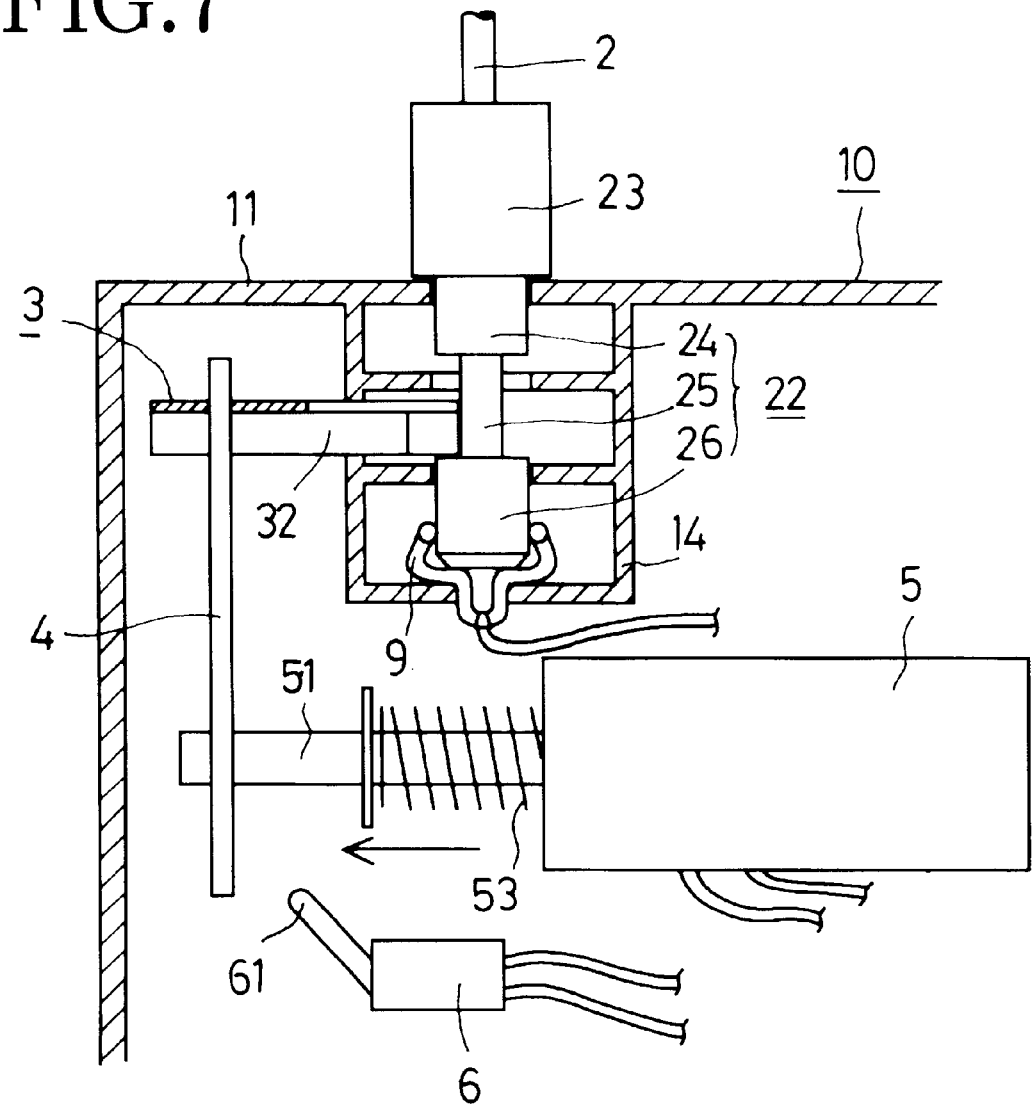
FIG. 7 is a front view partly broken away and showing the main construction with a solenoid in unlocking operative state.

Even if the rod 51 of the solenoid 5 projects as shown in FIG. 7 under the action of an impact or the like, unlocking the lock pin 22 which is locked to the tag body 10 as seen in FIG. 6, the switch 6 which is on is turned off to thereby execute the interrupt processing described above for the solenoid 5 to perform an attracting operation, locking the lock pin 22 to the tag body 10 again as seen in FIG. 6. Accordingly, the pin 22 is unlocked only for a moment, and there is no likelihood of the lock pin 22 slipping out of the tag body 10, hence safety.

If the wire 2 is cut by an unlawful act with the lock pin 22 locked to the tag body 10 as shown in FIG. 6, the signal to be input from the wire 2 shown in FIG. 9 to the microcomputer 73 changes from low to high, whereby the unlawful act is detected and reported. Alternatively if it is attempted to bring out an article and the tag body 10 from the monitoring area, with the lock pin 22 locked to the tag body 10 as shown in FIG. 6 and with the tag body 10 attached to the article, the receiving circuit 72 shown in FIG. 9 receives the alarm actuating signal emitted by the entrance-exit gate, with the result that the buzzer 8 goes on to give notice of the wrongful act.

When the monitoring clerk is to turn off the buzzer 8, the clerk manipulates the tag control unit to transmit an alarm cancel signal to the tag body 10. As a result, the buzzer 8 is brought out of alarming operation.

Even if a great pulling-out force acts on the lock pin 22 as locked to the tag body, the pair of spring pieces 32, 32 of the latch member 3 shown in FIG. 4 are in deep engagement with the lock pin 22, with the end face 26*a* of the second thick rod portion 26 reliably bearing on the spring pieces, hence no likelihood of unlocking.

The resistance offered to the latch member 4 in the course of reciprocating movement is limited only to very small frictional resistance given by the frame 14 of the tag body 10, and the lock pin 11 offers no resistance, so that there is no need for great electric power for driving the solenoid 5. Moreover, there is no need to energize the solenoid 5 for holding the lock pin 22 in the locked position as shown in FIG. 6. Even if a dry cell of small capacity is used as the power source, a long service life is available therefore.

The connector pin 9 in contact with the lock pin 22 as shown in FIG. 6 to connect the pin 22 to the input port of the microcomputer 73 has a bifurcated structure for clamping the second thick rod portion 26 of the lock pin 22 in the locked position, and is therefore unlikely to exert any force acting to push up the lock pin 22, i.e., acting to unlock the pin 22. This realizes a more reliable locked state.

What is claimed is:

1. A tag device comprising a tag body and a wire having a base end fixed to the tag body and a forward end connected to the tag body as releasably locked thereto, the wire being provided at its forward end with a lock pin having a thick rod portion at an axially outer end of a thin rod portion, the tag body comprising a case having a pin insertion hole permitting the lock pin to pass therethrough, and a latch member disposed inside the case and engageable with the lock pin when the lock pin is inserted through the hole, the latch member comprising a main body supported inside the case and reciprocatingly movable in directions orthogonal to the direction of insertion of the lock pin, and a pair of opposed resilient spring pieces integrally formed on the main body and being elastically oppositely shiftable in directions intersecting the direction of insertion of the lock pin permitting the spring pieces to engage the thin rod portion of the lock pin in an inserted position to prevent the thick rod portion from moving in a slipping-off direction when moved in one direction to a limit position, and means operative to move the latch member in the reciprocatingly movable directions for moving the spring pieces thereon away from the thin rod portion of the lock pin to allow the thick rod portion to move in the slipping-off direction when moved away from the limit position.

2. A tag device according to claim 1 wherein the thick rod portion of the lock pin is provided at an outer end thereof with a tapered face for laterally biasing the spring pieces of the latch member upon insertion of the lock pin.

3. A tag device according to claim 1 wherein said means incorporated in the tag body for reciprocatingly moving the latch member by an attracting/releasing movement of a rod comprises a soleniod and a control circuit for controlling the operation of the solenoid.

4. A tag device according to claim 3 wherein the solenoid as unenergized retains a locking operative state to hold the latch member moved to a lock pin locking position.

5. A tag device according to claim 4 wherein the solenoid is provided with a spring for biasing the rod from the locking operative state toward an unlocking operative state.

6. A tag device according to claim 4 wherein the tag body has a switch for detecting a movement of the latch member from the lock pin locking position to an unlocking position where the lock pin is unlocked, and the control circuit commands the solenoid to perform a locking operation upon detecting an unlocking operative state based on a detection signal from the switch.

7. A tag device according to claim 3 wherein the control circuit holds the solenoid in an unlocking operative state only for a specified period of time in response to an unlocking signal.

8. A tag device according to claim 3 wherein the tag body has a buzzer incorporated therein, and the control circuit gives an alarm command to the buzzer upon receiving an alarm actuating signal or upon detecting a break in the wire, with the lock pin locked by the latch member.

9. A tag device according to claim 8 wherein the tag body has a connector pin of metal for clamping the thick rod portion of the lock pin with the lock pin locked by the latch member, the connector pin being connected to the control circuit by a pulled-up signal line, the wire having its base end grounded, and the control circuit detects a break in the wire based on a signal to be input from the pulled-up signal line.

10. A tag device according to claim 8 wherein the control circuit gives an alarm stop command to the buzzer upon receiving an alarm cancel signal during alarming or when alarming continues for a predetermined period of time.

11. A tag device according to claim 3 wherein upon receiving an alarm actuating signal or upon detecting a break in the wire, with the lock pin locked by the latch member, a control circuit wirelessly emits an alarm information signal giving notice of the situation.

* * * * *